US010530087B2

(12) United States Patent
Kuster

(10) Patent No.: US 10,530,087 B2
(45) Date of Patent: Jan. 7, 2020

(54) CONNECTING ELEMENT

(71) Applicant: TECAN TRADING AG, Mannedorf (CH)

(72) Inventor: Martin Kuster, Eschenbach (CH)

(73) Assignee: TECAN TRADING AG, Mannedorf (CH)

( * ) Notice: Subject to any disclaimer, the term of this patent is extended or adjusted under 35 U.S.C. 154(b) by 0 days.

(21) Appl. No.: 16/373,073

(22) Filed: Apr. 2, 2019

(65) Prior Publication Data

US 2019/0312370 A1 Oct. 10, 2019

(30) Foreign Application Priority Data

Apr. 6, 2018 (EP) ..... 18166127

(51) Int. Cl.

| | |
|---|---|
| ***H01R 13/33*** | (2006.01) |
| ***H01R 13/04*** | (2006.01) |
| ***H01R 13/42*** | (2006.01) |
| ***H01R 13/10*** | (2006.01) |
| ***H01R 43/20*** | (2006.01) |
| ***H01R 4/48*** | (2006.01) |

(52) U.S. Cl.

CPC ..... *H01R 13/33* (2013.01); *H01R 4/4863* (2013.01); *H01R 13/04* (2013.01); *H01R 13/10* (2013.01); *H01R 13/42* (2013.01); *H01R 43/205* (2013.01)

(58) Field of Classification Search

CPC ..... H01R 13/33

See application file for complete search history.

(56) References Cited

U.S. PATENT DOCUMENTS

| | | | | |
|---|---|---|---|---|
| 3,058,083 | A * | 10/1962 | Schneider | H01R 4/4863 439/82 |
| 3,503,033 | A * | 3/1970 | Kennedy, Jr. | H05K 3/308 439/75 |
| 4,192,567 | A * | 3/1980 | Gomolka | H01R 13/33 439/320 |
| 7,062,053 | B2 * | 6/2006 | Hohjyo | H04R 1/06 381/174 |
| 2008/0049408 | A1 * | 2/2008 | Yamauchi | H01G 2/14 361/772 |
| 2009/0156026 | A1 * | 6/2009 | Ohmori | F21V 19/008 439/81 |
| 2009/0259264 | A1 * | 10/2009 | Firth | A61N 1/05 607/2 |
| 2010/0267291 | A1 * | 10/2010 | Chabineau-Lovgren | H01R 13/2421 439/817 |
| 2011/0059661 | A1 * | 3/2011 | Inomata | H01R 13/111 439/841 |
| 2013/0056239 | A1 * | 3/2013 | Hayama | H01R 4/4863 174/110 R |

(Continued)

*Primary Examiner* — James Harvey

(74) *Attorney, Agent, or Firm* — Notaro, Michalos & Zaccaria P.C.

(57) ABSTRACT

A connecting element with a screw-in element and a contact element. The screw-in element is pin-shaped and extends along a longitudinal axis, has a thread on its first free end, a drive profile and a reception on its second free end, wherein the contact element is arranged in the reception with its first free end and has a connecting pin on its second free end that extends beyond the screw-in element in the direction of the longitudinal axis, wherein the contact element has a spring that is arranged between the screw-in element and the connecting pin.

17 Claims, 7 Drawing Sheets

(56) References Cited

U.S. PATENT DOCUMENTS

2016/0290879 A1* 10/2016 Kohler ..... G01L 1/16
2016/0294080 A1* 10/2016 Petrarca ..... H01R 12/712

* cited by examiner

CONNECTING ELEMENT

TECHNICAL FIELD OF THE INVENTION

The current invention relates to a connecting element, in particular an electrical connecting element.

DESCRIPTION OF THE RELATED ART

From the prior art, connecting elements are known which comprise, for example, a pin which can be releasably inserted into a corresponding pin receptacle. When using such fasteners, it is very important that the manufacturing and assembly tolerances are met, otherwise the connecting element cannot be inserted into a corresponding socket.

SUMMARY OF THE INVENTION

A task of the present invention consists of providing a connecting element, which can be inserted safely into a corresponding socket even if the manufacturing and assembly tolerances are bigger.

This task is solved by a connecting element with the features of the invention. Further embodiments of the connecting element, as well as a connecting assembly are defined by features of further claims.

A connecting element according to the invention comprises a screw-in element and a contact element, wherein the screw-in element is formed pin-shaped and extends along a longitudinal axis. On its first free end, the screw-in element comprises a thread and on its second free end a screw drive profile and a reception. The contact element is arranged in the reception with its first free end comprises a connecting pin on its second free end which extends over the screw-in element in the direction of the longitudinal axis. The contact element comprises a spring which is arranged between the screw-in element and the connecting pin. By means of the spring, manufacturing inaccuracies can be compensated. Meaning the screw-in elements need not be aligned exactly with the corresponding sockets, so that the contact elements can be inserted into the sockets.

In an embodiment, the drive profile of the screw-in element comprises an inner profile, for example an internal hex profile. However, slot, cross or Torx profiles can be provided as well. The reception of the screw-in element comprises a peripheric recess, wherein the first free end of the contact element comprises the spring and is arranged in the peripheric recess by means of the spring. The cross-section of the peripheric recess can be the same as the cross-section of the corresponding spring. Alternatively, the cross-sections can be designed differently. For example, the peripheric recess can be a spiral with an angular or round cross section. The spring can be a spiral spring with an angular or round cross-section.

In one embodiment, the peripheric recess is identical with the thread and extends along the entire length of the screw-in element. Alternatively, the peripheric recess and the thread can be designed differently. For example, the spiral of the peripheric recess can comprise a bigger cross-section than the one of the thread.

In an embodiment, the screw drive profile of the screw-in element comprises an external profile, wherein the screw-in element comprises a fixation pin with a peripheric recess on its second free end and wherein the first free end of the contact element comprises the spring element and is arranged in the peripheric recess by means of the spring.

In an embodiment, the fixation pin is formed integrally in a single piece with the screw-in element.

In an embodiment, the fixation pin is arranged in a centric recess in the screw-in element.

In an embodiment, the screw drive profile of the screw-in element comprises an external profile, wherein the screw-in element comprises a centric reception on its second free end, wherein the first free end of the contact element comprises the spring and a fixation pin and is arranged in the centric reception.

In an embodiment, the contour of the contact element, in the region of the reception, is essentially congruent with the one of the reception and represents an accurately fitting connection.

In an embodiment, the connecting pin essentially extends along the longitudinal axis, in the extension of the longitudinal center line of the screw-in element. Alternatively, the connecting pin can be arranged offset to the longitudinal axis and can extend essentially in the direction of the longitudinal axis. The connecting pin can also be arranged tangentially to a lateral surface of the screw-in element.

In an embodiment, the screw-in element and the contact element are made from an electrically conductive material and are electrically connected to one another.

The mentioned embodiments of the connecting element can be used in any combination, unless they contradict each other.

A connecting assembly according to the invention comprises a first component, wherein the first component comprises at least a tap hole, wherein a connecting element according to one of the previously described embodiments is screwed in at least one of the tap holes.

In an embodiment, the connecting assembly further comprises at least one second component, wherein each second component comprises at least one socket, wherein the connecting pin of the at least one connecting elements, in its intended use position, is arranged in the at least one socket.

In an embodiment, the socket is designed as such that connectors of the first component can be connected to connectors of the second components by means of the connecting element and the corresponding socket.

In an embodiment, a front side at the first free end of the screw-in element of the respective connecting element is in electric contact with the corresponding connector of the first component.

In an embodiment, at least one of the tap holes comprises a sink, in which the contact element can be inserted, at least partially. Alternatively, the tap hole can be provided without sink.

The mentioned embodiments of the connecting assembly can be used in any combination, unless they contradict each other.

BRIEF DESCRIPTION OF THE DRAWINGS

Embodiments of the current invention are described in more detail in the following with reference to the figures. These are for illustrative purposes only and are not to be construed as limiting. It shows FIG. 1 a perspective view of an embodiment of a connecting element according to the invention.

DETAILED DESCRIPTION OF THE INVENTION

Figure 1:
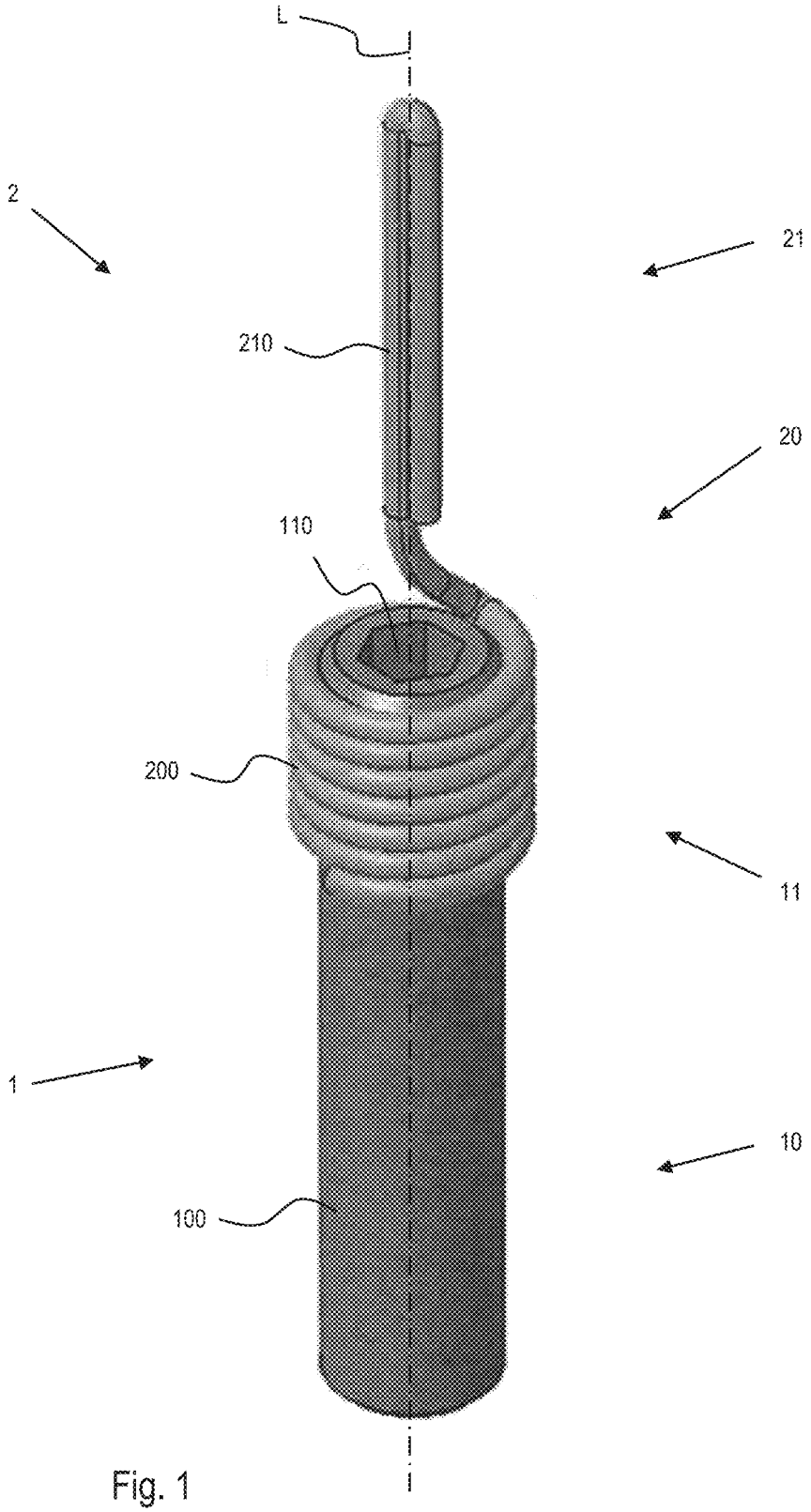

FIG. 1 shows a perspective view of an embodiment of a connecting element according to the invention. The connecting element comprises a screw-in element 1 and a contact element 2 that is arranged on the screw-in element 1. The screw-in element 1 is pin-shaped and extends along a longitudinal axis L. A thread 100 is provided on a first free end 10 of the screw-in element 1 and a drive profile 110 in the form of an internal hex profile is provided on a second free end 11. The contact element 2 comprises a spring 200 on a first free end 20 and a connecting pin 210 on a second free end. The contact element 2 is arranged on the second free end 11 of the screw-in element by means of the spring 200.

Figure 2A:
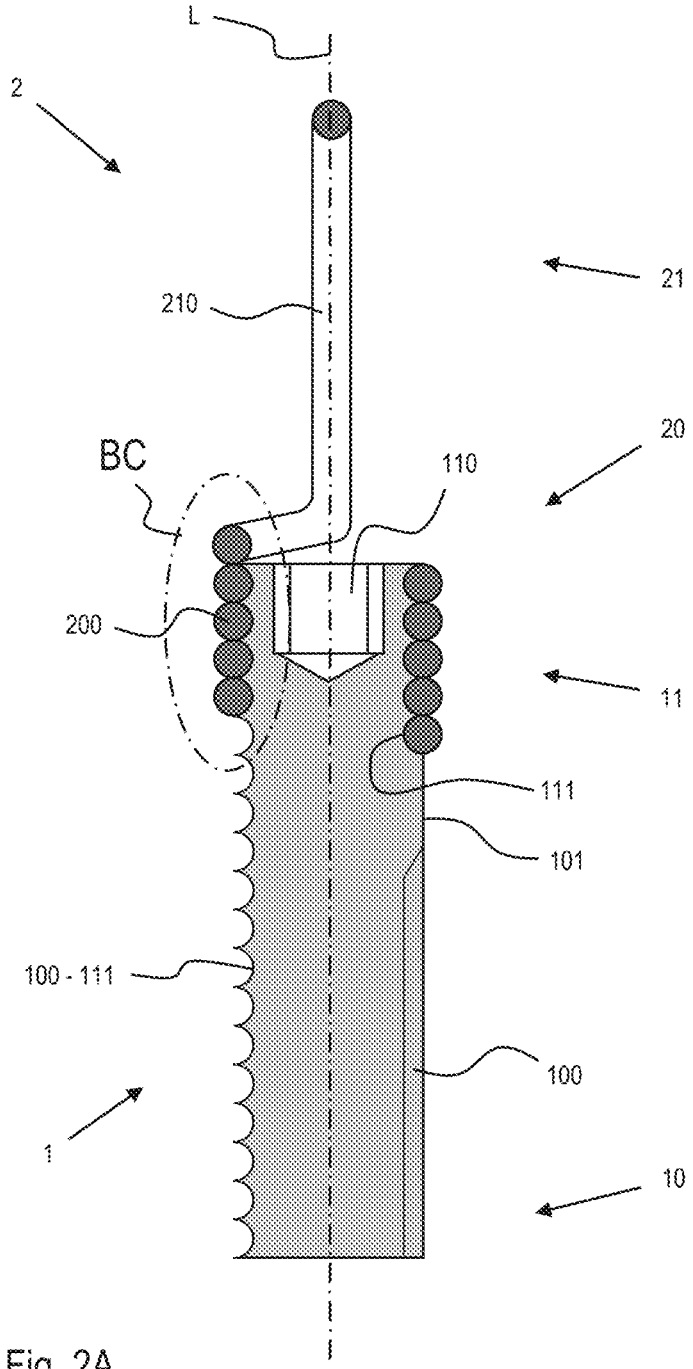
FIG. 2A a schematic sectional view through the longitudinal axis of an embodiment of a connecting element according to the invention.

FIG. 2A shows a schematic sectional view through the longitudinal axis L of an embodiment of a connecting element according to the invention, wherein a first embodiment of the screw-in element 1 is shown on the right side and wherein a second embodiment is shown on the left side. The first embodiment of the screw-in element 1 comprises a thread 100 on its lateral surface 101 which thread extends from the first free end 10 on and a reception 111 which extends from the second free end 11 on.

Figure 2B:
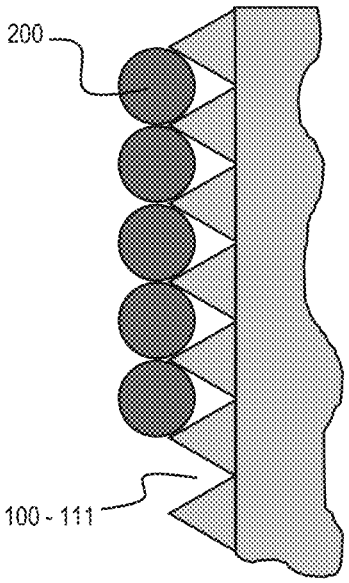
FIG. 2B and FIG. 2C show alternative detail views of FIG. 2A.
Figure 2C:
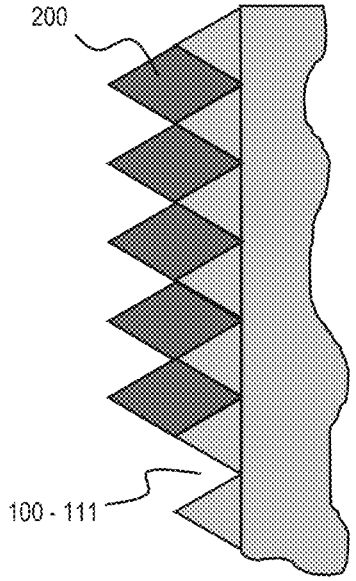

The reception 111 is a spiral-shaped recess with a circular cross-section. The outer contours of the reception 111 are congruent with the inner contours of the spring 200 of the contact element 2. The thread 100 is designed finer than the reception 111. In inner profile 110 is provided on the second free end. At the second embodiment of the screw-in element 1, the thread 100 is identical to the reception 111 and extends from the first free end 10 to the second free end 11. The outer contours of the thread 100 and the reception 111 respectively, are congruent with the inner contours of the spring 200 of the contact element 2. Generally, all combination of threads 100 and springs 200 are suitable, in which the pitch of the thread 100 equals the pitch of the spring 200. FIG. 2B shows a combination of a thread 100 and a reception 111 respectively, with the shape of a V-thread and spring 200 with a spring wire with a circular cross-section. FIG. 2C shows a combination of a V-shaped thread 100 with a spring 200 with a spring wire with a trapezoidal cross-section. Generally, all known kinds of thread are possible as a reception 100, such as, for example, trapezoidal thread, round thread or flat thread. Springs 200 with spring wires with round, oval or polygonal cross-sections can be used as well.

Figure 3:
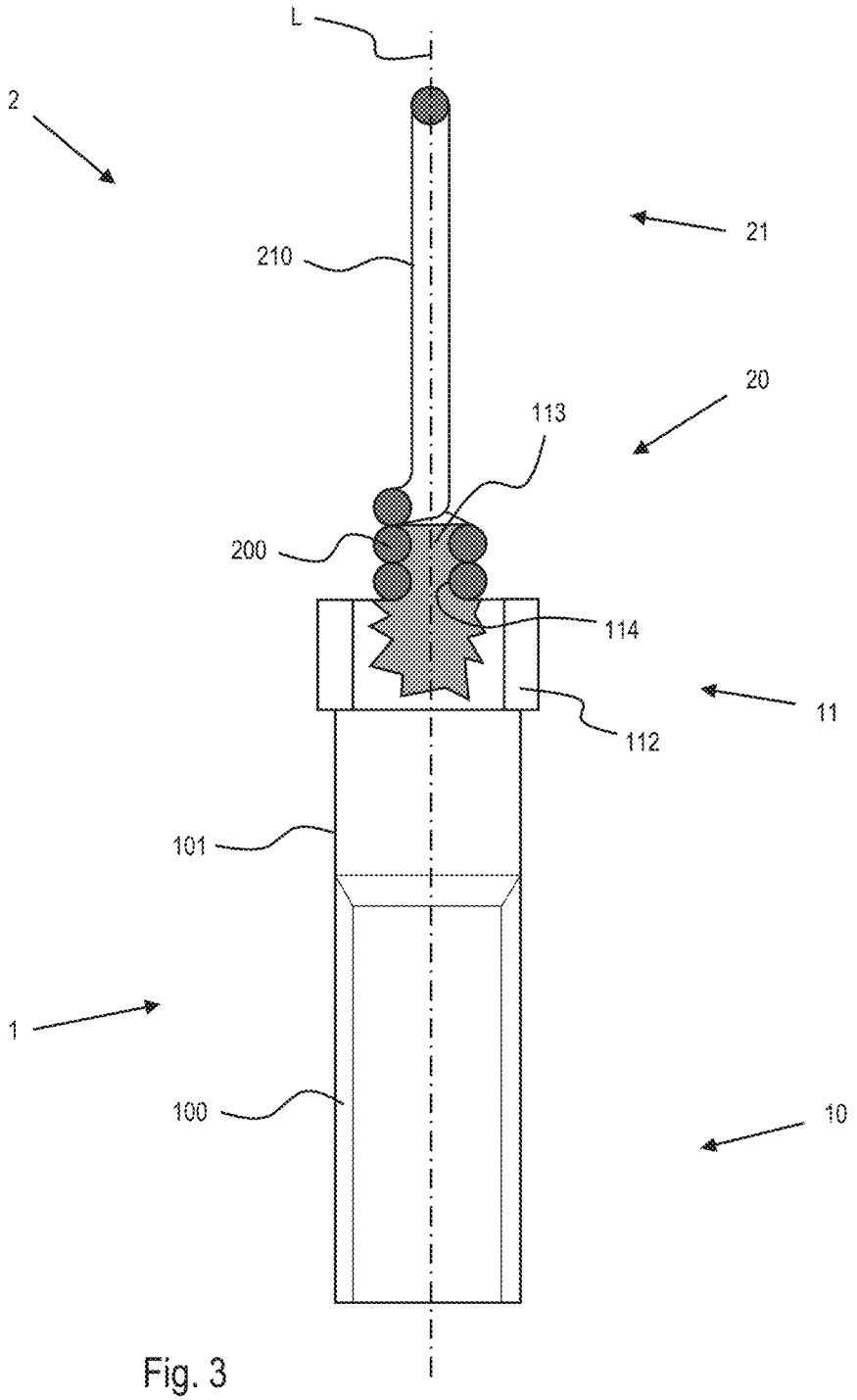
FIG. 3 a schematic sectional view of an alternative embodiment of a connecting element according to the invention.

FIG. 3 shows a schematic sectional view of an alternative embodiment of a connecting element according to the invention. A outer profile 112 is provided on the second free end 11 of the screw-in element 1 as a drive profile, for example a hexagonal profile. Adjacent to it, a mounting pin 113 with a peripheric reception 114 is arranged, wherein the mounting pin 113 is formed integrally in a single piece with the screw-in element 1. The peripheric reception 114 is a spiral-shaped recess. The spring 200 of the contact element 2 is arranged in the peripheric reception 114. The outer contours of the reception 114 are congruent with the inner contours of the spring 200.

Figure 4:
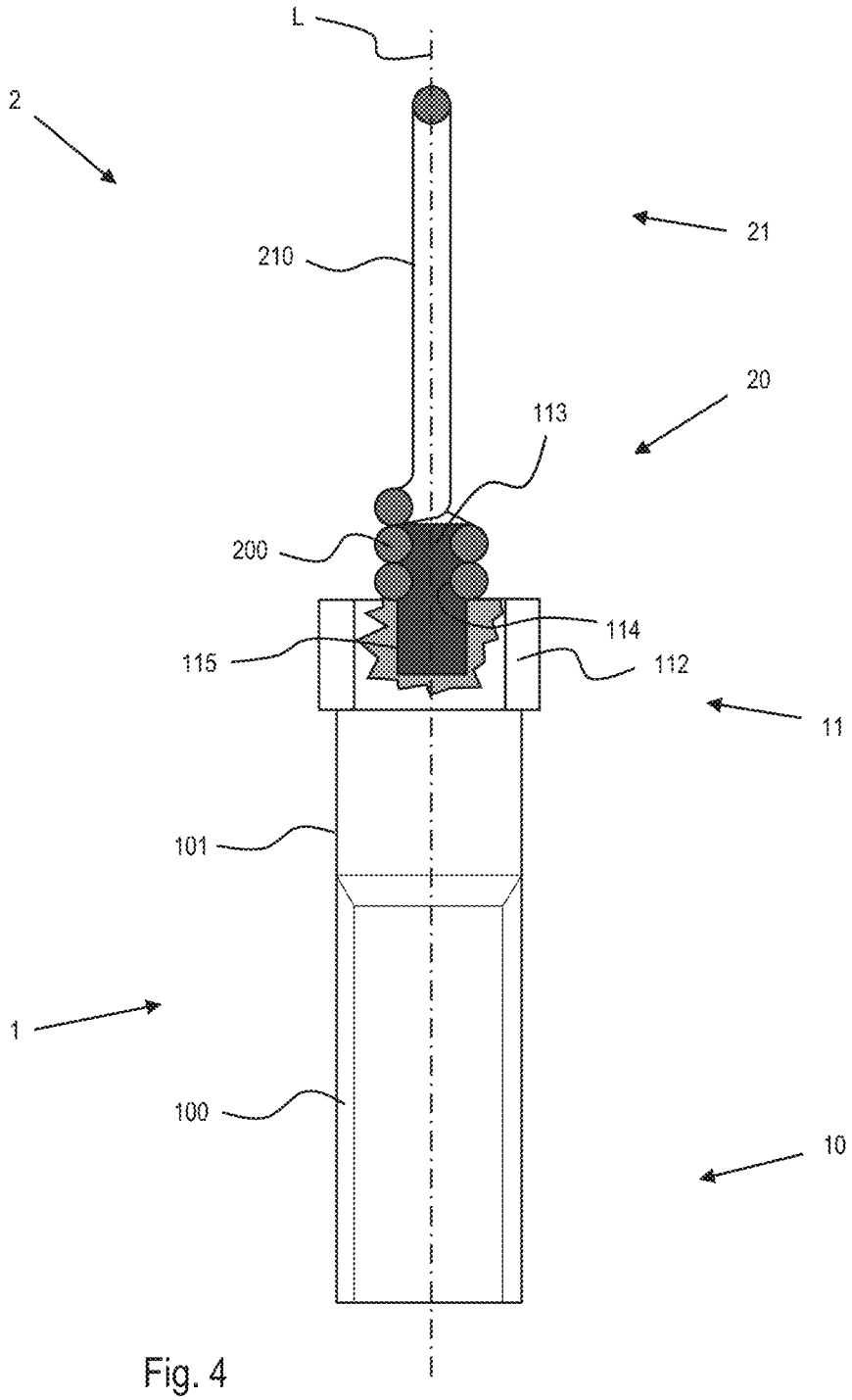
FIG. 4 a schematic sectional view of an alternative embodiment of a connecting element according to the invention.

FIG. 4 shows a schematic sectional view of an alternative embodiment of a connecting element according to the invention. In contrast to the embodiment of FIG. 3, the pin 113 is arranged in a centric reception 115 which is formed frontal on the second free end 11 of the screw-in element 1. The centric reception is a recess in the form of a borehole. The pin 113 comprises the peripheric reception 114 and the spring 200 is arranged in the peripheric recess 114.

Figure 5:
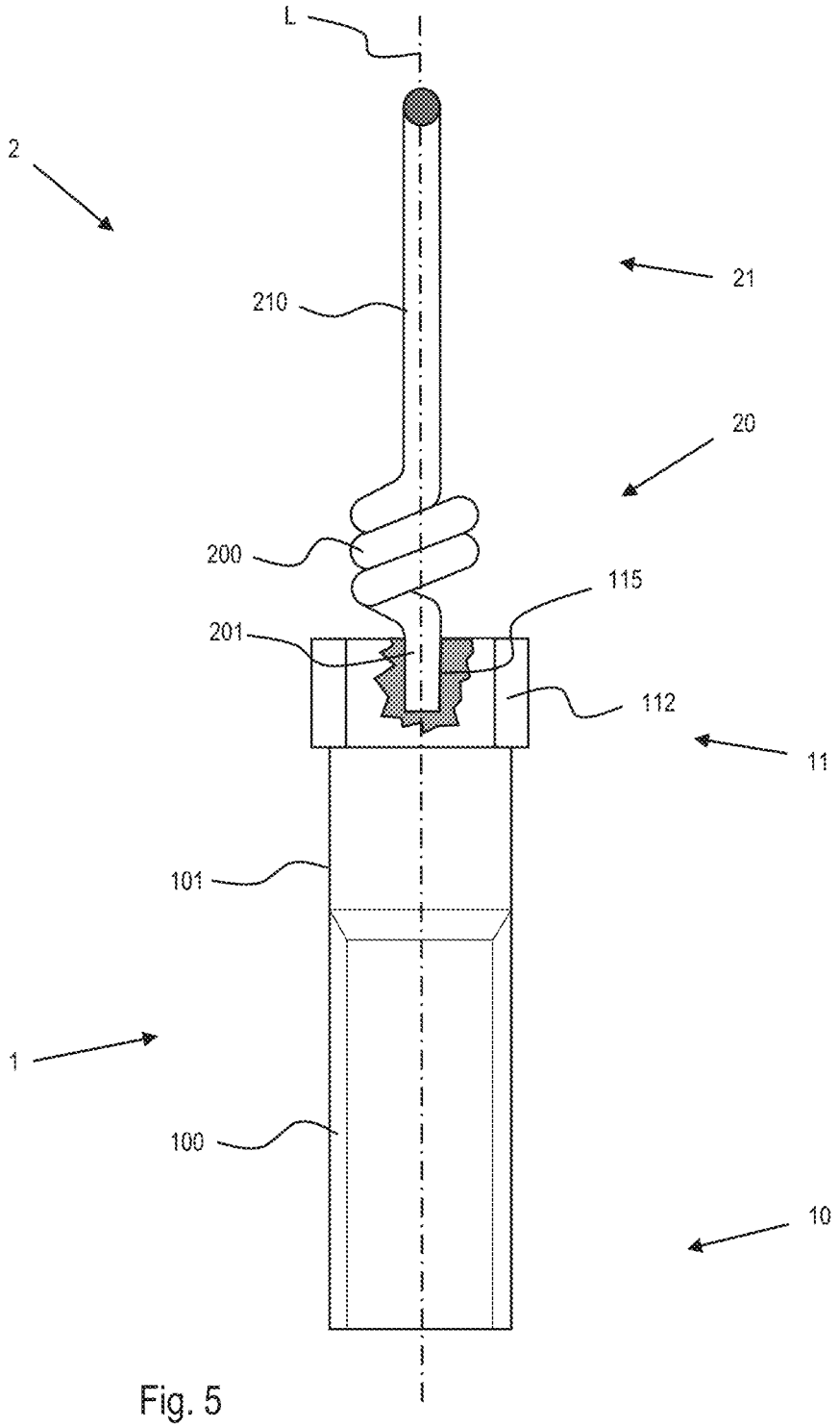
FIG. 5 a schematic sectional view of an alternative embodiment of a connecting element according to the invention.

FIG. 5 shows a schematic sectional view of an alternative embodiment of a connecting element according to the invention. The screw-in element 1 comprises a peripheric drive profile 112 on the second fee end 111 and a frontally arranged centric reception 115. The contact element 2 comprises the spring 200 and a mounting pin 201 on the second fee end 20. The contact element 2 is arranged in the centric reception 115 of the screw-in element 1 by means of the mounting pin 201.

FIGS. 6A-6D show different embodiments of connecting pins 210 of contact elements 2 according to the invention.

Figure 6A:
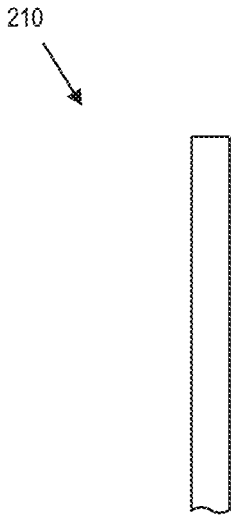
FIGS. 6A, 6B, 6C and 6D show various embodiments of connecting pins of connecting elements according to the invention.

FIG. 6A shows a simple straight pin with an end face on the free end. Alternatively, the free end may be rounded.

Figure 6B:
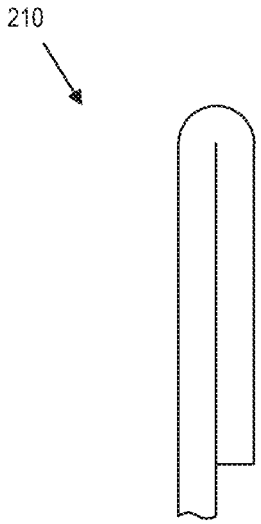

FIG. 6B shows a simple bent pin, wherein the two shanks adjoining the bend extend parallel to each other and are abutting each other.

Figure 6C:
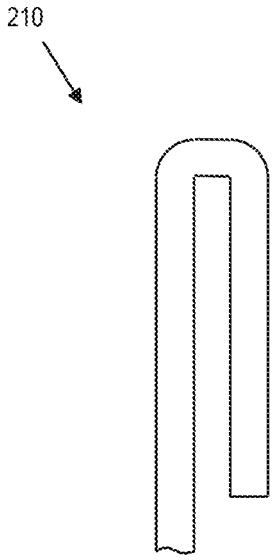

FIG. 6C shows a U-shaped pin, wherein the two shanks adjoining the middle part extend parallel to each other and at a distance to one another and wherein the middle part extends essentially perpendicular to the two shanks.

Figure 6D:
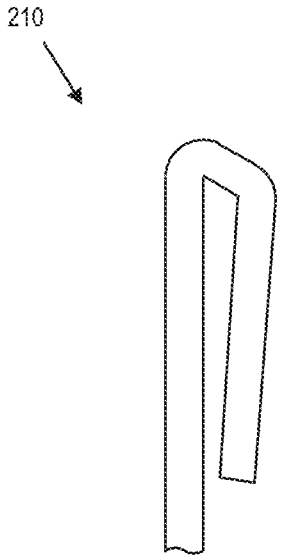

FIG. 6D shows a U-shaped pin, wherein the two shanks adjoining the middle part converge in a direction away from the middle part and the middle part being inclined, i.e. is not oriented perpendicularly to the two shanks.

Figure 7:
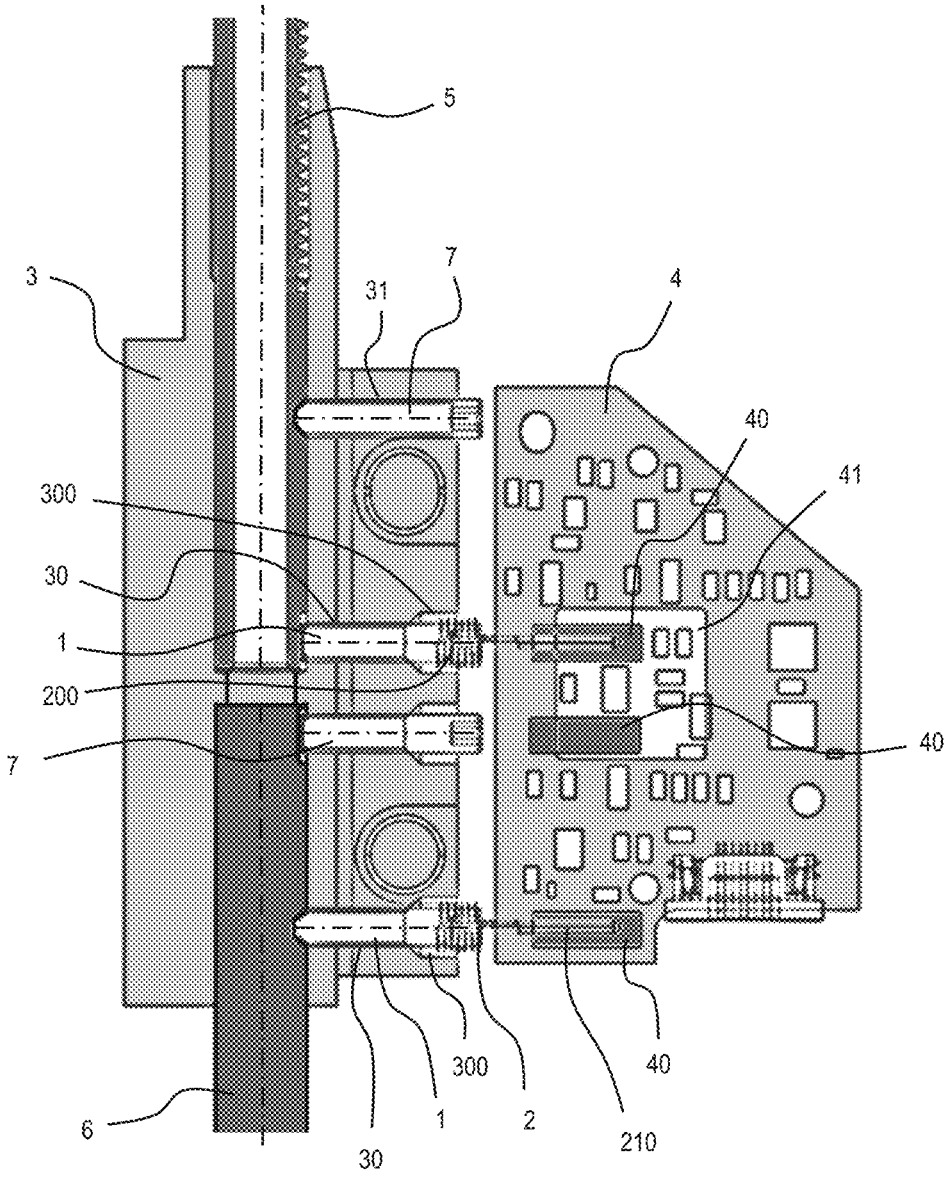
FIG. 7 a schematic sectional view through a connecting assembly according to the invention.

FIG. 7 shows a schematic sectional view through a connecting assembly according to the invention. The assembly comprises a first component 3 which is connected to a second component 4 by means of connecting elements 1,2. The first component 3 comprises a first connector 5 which is fixed in the first component 3 by means of fixation elements 7. Depicted is a toothed rack as connector 5, which can be, for example, the movable Z-axis of a manipulator. The toothed rack 5 is fixed to the housing of the first component 3 by a threaded pin 7. The threaded pin 7 is screwed in a tap hole 31 of the first component 3. The connecting element 1,2 is screwed in a further tap hole 30, wherein the front face of the screw-in element 1 is electrically conductive in contact with the toothed rack 5. The further tap hole 30 comprises a sink 300 on its side oriented towards the second component 4, wherein the diameter of the sink is bigger than the one of the sections of the further bore hole with the thread. The spring 200 of the contact element 2 is partially arranged in the sink 300. The spring 200 and the connecting pin 210 extend from the first component 3 away. A second connector 6 is fixed in the housing of the first component 3 by means of a threaded pin 7 with an internal hex, separated from the first connector 5. A connecting element 1,2 according to the invention is in electric contact with the second connector 6. The second component 4 comprises sockets 40, in which the connecting pins 210 of the connecting elements 2 can be inserted to provide an electric contact. The second component 4 further comprises terminals 41 which are electrically connected to the sockets. The first connector 5 of the first component 3 is electrically connectable with the second connector 6 of the second component 4 by means of the connecting elements 1,2, the sockets 40 and the terminals 41.

| REFERENCE SIGNS LIST | |
|---|---|
| 1 | screw-in element |
| 10 | first free end |
| 100 | thread |
| 101 | lateral surface |
| 11 | second free end |
| 110 | centric screw drive profile |
| 111 | peripheric reception |
| 112 | peripheric screw drive profile |
| 113 | pin |
| 114 | peripheric reception |
| 115 | centric reception |
| 2 | Contact element |
| 20 | first free end |
| 200 | spring |
| 201 | fixating pin |
| 21 | second free end |
| 210 | connecting pin |
| 3 | first component |
| 30 | tap hole |
| 300 | sink |
| 31 | tap hole |
| 4 | second component |
| 40 | socket |
| 41 | terminal |
| 5 | first connector |
| 6 | second connector |
| 7 | fixation element |
| L | longitudinal axis |

The invention claimed is:

1. A connecting element with a screw-in element (1) and a contact element (2), wherein the screw-in element (1) is pin-shaped and extends along a longitudinal axis (L), wherein the screw-in element (1) comprises a thread (100) on its first free end (10) and comprises a drive profile (110,112) and a reception (111,114;115) on its second free end (11), wherein the contact element (2) is arranged in the reception (111,114;115) with its first free end (20) and comprises a connecting pin (210) on its second free end (21) which extends beyond the screw-in element (1) in the direction of the longitudinal axis (L), characterized in that the contact element (2) comprises a spring (200) which is arranged between the screw-in element (1) and the connecting pin (210).

2. The connecting element according to claim 1, wherein the drive profile of the screw-in element (1) comprises an inner profile (110), wherein the reception of the screw-in element (1) comprises a peripheric reception (111) and wherein the first free end (20) of the contact element (2) comprises the spring (200) and is arranged in the peripheric reception (111) with the spring (200).

3. The connecting element according to claim 2, wherein the peripheric reception (111) is identical with the thread (100) and extends along the entire length of the screw-in element (1).

4. The connecting element according to claim 1, wherein the drive profile of the screw-in element (1) comprises an external profile (112), wherein the screw-in element (1) comprises a fixation pin (113) with a peripheric reception (114) on its second free end (11) and wherein the first free end (20) of the contact element (2) comprises the spring (200) and is arranged in the peripheric reception (114) with the spring (200).

5. The connecting element according to claim 4, wherein the fixation pin (113) is formed integrally in a single piece with the screw-in element (1).

6. The connecting element according to claim 4, wherein the fixation pin (113) is arranged in a centric reception (115) in the screw-in element (1).

7. The connecting element according to claim 1, wherein the drive profile of the screw-in element (1) comprises an outer profile (112), wherein the screw-in element (1) comprises a centric reception (115) on its second free end (11), wherein the first fee end (20) of the contact element (2) comprises the spring (200) and a fixation pin (201) and is arranged in the centric reception (115) with the fixation pin (201).

8. The connecting element according to claim 1, wherein in the region of the reception (111,114;115), the contours of the contact element (2) are essentially congruent with the reception (111,114;115) and constitute a precisely fitting connection.

9. The connecting element according to claim 1, wherein the screw-in element (1) and the contact element (2) are made from an electrically conductive material and are electrically connected to each another.

10. A connecting assembly comprising a first component (3), wherein the first component (3) comprises at least one tap hole (30,31), characterized in that a connecting element according to claim 1 is screwed in the at least one of the tap holes (30).

11. The connecting assembly according to claim 10, further comprising at least one second component (4), wherein each second component (4) comprises at least one socket (40), wherein the connecting pin (210) of the at least one connecting element, in its intended use position, is arranged in the at least one socket (40).

12. The connecting assembly according to claim 11, wherein the socket (40) is designed as such that connectors (5,6) of the first component (3) can be electrically connected to terminals (41) of the second component (4) by means of the connecting elements and the sockets (40).

13. The connecting assembly according to claim 12, wherein a front side on the first free end (10) of the screw-in element (1) of the respective connecting element is in an electric contact with the corresponding connector (5,6) of the first component (3).

14. The connecting assembly according to claim 10, wherein at least one of the tap holes (30) comprises a sink (300), in which the contact element (2) is arranged, at least partially.

15. The connecting assembly according to claim 11, wherein at least one of the tap holes (30) comprises a sink (300), in which the contact element (2) is arranged, at least partially.

16. The connecting assembly according to claim 12, wherein at least one of the tap holes (30) comprises a sink (300), in which the contact element (2) is arranged, at least partially.

17. The connecting assembly according to claim 13, wherein at least one of the tap holes (30) comprises a sink (300), in which the contact element (2) is arranged, at least partially.

* * * * *